United States Patent [19]

Gentile

[11] 4,138,913

[45] Feb. 13, 1979

[54] PUNCH PRESS FEEDING APPARATUS

[75] Inventor: Patrick J. Gentile, Pittsburgh, Pa.

[73] Assignee: Vamco Machine and Tool, Inc., Pittsburgh, Pa.

[21] Appl. No.: 836,310

[22] Filed: Sep. 26, 1977

[51] Int. Cl.[2] ..... B26D 5/22

[52] U.S. Cl. ..... 83/236; 83/336; 83/202

[58] Field of Search ..... 83/236, 202, 238, 234, 83/336

[56] References Cited

U.S. PATENT DOCUMENTS

| | | | |
|---|---|---|---|
| 1,430,089 | 9/1922 | Lazaga | 83/236 |
| 1,490,549 | 4/1924 | Woodworth | 83/236 |
| 1,543,434 | 6/1925 | Hardman | 83/236 X |
| 2,047,221 | 7/1936 | Pechy | 83/236 X |
| 3,483,782 | 12/1969 | Eyberger | 83/202 |

*Primary Examiner*—Donald R. Schran

*Attorney, Agent, or Firm*—Stanley J. Price, Jr.; John M. Adams

[57] ABSTRACT

An input shaft is drivingly connected to a crankshaft of a punch press for rotation at a preselected speed. A geared cam drive drivingly connects the input shaft to a driven feed roll so that continuous rotation of the input shaft is converted to intermittent rotation of the feed roll. The intermittent rotation of the feed roll is timed with the punching operation so that the feed roll intermittently advances a preselected length of stock material to the punch press after each punching operation. Bevel gears drivingly connect the input shaft to a pull roll that rotates to continuously unreel stock material from a coil. During the punching operation, rotation of the feed roll is interrupted forming a loop in the stock material between the pull roll and the feed roll. At the end of each punching operation the material forming the loop is fed by the feed roll to the punch press so that the stock material between the pull roll and the feed roll moves from a loop to a horizontal position to insure feeding the same length of material to the punch press for each cycle of operation.

5 Claims, 3 Drawing Figures

PUNCH PRESS FEEDING APPARATUS

BACKGROUND OF THE INVENTION

1. Field of the Invention

This invention relates to apparatus for feeding stock material from a coil to a punch press in timed relation with the punching operation and more particularly to apparatus for continuously advancing the stock material from a coil and intermittently feeding a preselected length of the stock material to the punch press in timed relation with the punching operation.

2. Description of the Prior Art

It is the conventional practice in high speed automatic press operations to feed a strip of material from a coil to the dies of the press for punching, stamping, cutting or the like of a preselected length of the material. The material must be fed from the coil in timed relation with the punching operation so that when the dies contact the material, the material is released from the feed so that the feed is interrupted and the material is stationarily positioned between the dies. After the punching operation is completed the feed is actuated to advance another preselected length of the material to the press. Therefore, the feeding of the stock material to the press must be coordinated with each punching operation so that prior to each operation a new segment of the material is in position relative to the dies for punching.

U.S. Pat. No. 3,483,782 illustrates and describes a self-contained feed roll for power punch presses. A feed roll is drivingly connected to the punch press crankshaft. An index drive receives the continuous rotation of the crankshaft and converts it to non-continuous, incremental movement of the index drive output shaft which is drivingly connected to the feed roll. With this arrangement the feed roll is not rotated during the pressing portion of the punch press operating cycle. After the punching portion of the operating cycle, the feed roll is rotated to advance another preselected length of stock material to the press dies. The feeding portion of the operating cycle is complete prior to the punching portion.

The following United States Patents relate to material punching and cutting apparatus in which stock material is unreeled from a coil and strips of a preselected length are severed from the unreeled material: U.S. Pat. Nos. 2,272,215; 2,314,367; 2,480,781; 3,053,129; 3,102,673; 3,143,938; 3,244,045; 3,515,553; 3,768,349 and 3,978,703. The principal factor in feeding the stock material to the punch press is coordinating the feeding operation with the punching operation. It is known to provide separate drive for the feed mechanism and the punch press. This, however, creates considerable difficulty in maintaining a timed relation between the feeding operation and the punching operation. Adjustments are generally required by an expert technician to maintain the feeding operation coordinated with the punching operation.

To overcome the problems with providing separate drives for the feed mechanism and the punch press, the feed mechanism is drivingly connected to the punch press. However, because feeding of the stock material to the punch press is intermittent it is not possible without some accommodation to continuously unreel the stock material. Additionally, it was the conventional practice to provide separate drive means for continuously unreeling the stock material from the coil and for intermittently feeding the stock material to the punch press. U.S. Pat. Nos. 2,314,367; 2,272,215; 2,480,781 and 3,053,129 disclose a single drive motor to provide both continuous unreeling from a coil and intermittent feeding to a punch press. To accommodate the periodic interruption of the material feeding, a loop is formed for storing the excess material during the punching operation. Thereafter the material is then fed from the loop to the punch press for subsequent punching. However, unless the same length of material is fed after each punching operation, the resultant product will deviate from the desired configuration.

There is need for an apparatus to control the feeding of stock material to an automatic punch press in which a common power source is provided for continuously unreeling the stock material from a coil and intermittently feeding the stock material to the punch press in timed relation with the punching operation. While it has been suggested by the prior art devices to provide a single drive for continuously unreeling the stock material and intermittently feeding the stock material to a punch press, the prior art devices do not provide means for insuring that the same length of material is fed to the punch press for each cycle of operation.

SUMMARY OF THE INVENTION

In accordance with the present invention there is provided apparatus for the controlled feeding of stock material to a punching apparatus in which a pull device continuously pulls a stock material from a source. An intermittent feed device intermittently feeds a preselected length of the stock material to the punching apparatus so that during the punching operation feed of the stock material to the punching apparatus is interrupted. A driven input shaft is drivingly connected to the pull and intermittent feed devices. A first drive mechanism converts continuous rotation of the input shaft to provide intermittent rotation of the intermittent feed device. Thus a preselected length of the stock material is intermittently fed to the punching apparatus in timed relation with each punching operation. A second drive mechanism transmits continuous rotation of the driven input shaft to the pull device and consequently the stock material is continuously advanced at a preselected speed to the feed device. When a preselected length of stock material is being punched, the feed device interrupts feed to the punching apparatus and with the pull device operating a loop is formed in the stock material between the pull device and the feed device. Upon actuation the intermittent feed device feeds the stock material forming the loop to the punching apparatus and the stock material positioned between the pull device and the intermittent feed device assumes a substantially horizontal position.

The input shaft is connected by a belt drive to the crankshaft of the punching apparatus. As the crankshaft rotates, the direct drive to the input shaft provides for rotation of the input shaft. The first drive mechanism then converts the continuous rotary motion of the input shaft to the intermittent motion of the intermittent feed device. The feed device includes a pair of feed rolls, a driven roll and an idler roll that frictionally engage the stock material. The driven feed roll is drivingly connected through an arrangement of reduction gears to one end of an output shaft. The opposite end portion of the output shaft is drivingly connected to the first drive mechanism.

The first drive mechanism includes a geared cam drive having a cam portion connected to the input shaft and a cam follower portion connected to the output shaft of the driven feed roll. During the dwell period of rotation of the cam portion, the output shaft is not rotated so that the driven feed roller interrupts feed to the punching apparatus. At this time the punching operation is performed and the stock material being fed by the pull rolls form a loop between the pull rolls and the feed rolls. Rotation of the cam portion is timed so that when the punch retracts, the cam follower portion is actuated and the output shaft is rotated. Rotation of the output shaft rotates the driven feed roll at a preselected speed to feed the length of stock material forming the loop to the punching apparatus. At the end of the feeding operation the stock material is moved to a substantially horizontal position between the pull rolls and the feed rolls. With this arrangement, the same length of stock material is fed to the punching apparatus after each punching operation.

The continuously driven pull roll is connected through a preselected arrangement of reduction gears to one end of a second output shaft that is drivingly connected by the second drive mechanism to the input shaft. The second drive mechanism includes a pair of meshing bevel gears, a first bevel gear nonrotatably connected to the second output shaft and a second bevel gear nonrotatably connected to the input shaft. With this arrangement rotation of the input shaft is transmitted by the meshing bevel gears to the second output shaft and therefrom through reduction gears to the driven pull roll. Preferably, the driven pull roll continuously unreels the stock material from a coil at one half the rate the feed rolls intermittently feed preselected lengths of the stock material to the punching apparatus.

With the arrangement the feeding operation is timed with the punching operation to permit continuous unreeling of stock material from a coil of material and intermittent feeding of preselected lengths of material to the punching apparatus before each downward stroke of the punch. Thus, during the punching operation a loop is formed in the stock material. However, when the output shaft of the feed roll is rotated by the cam portion after the material is punched the loop is removed by feeding the material forming the loop to the punching apparatus. The feed rolls advance to the punching apparatus exactly the length of material that forms the loop. As a result, at the end of the feeding operation all the material stored in the loop is fed to the punching apparatus. The material then takes a substantially horizontal position between the pull rolls and the feed rolls.

Accordingly, the principal object of the present invention is to provide apparatus for rotating pull rolls and feed rolls for the timed feeding of stock material to a punching apparatus.

Another object of the present invention is to provide for the controlled feeding of strips of stock material to a punching apparatus in which the material is continuously unreeled from a coil and preselected lengths of the material are intermittently fed to the punching apparatus so that after each punching operation a loop is formed in the material and after each feeding operation the loop is removed.

These and other objects of the present invention will be more completely disclosed and described in the following specification, the accompanying drawings and the appended claims.

DESCRIPTION OF THE PREFERRED EMBODIMENT

Figures 1, 2, 3:
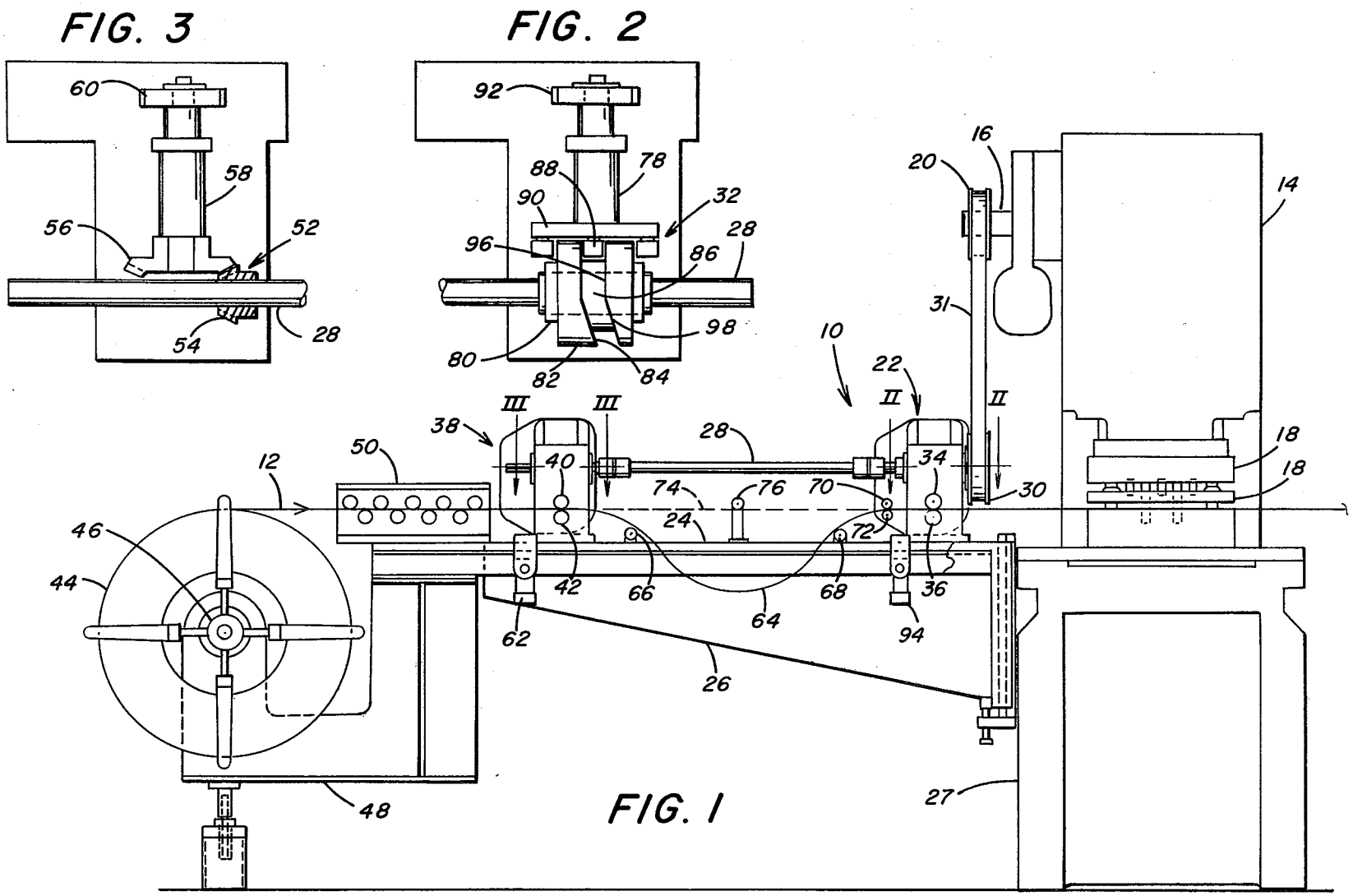
FIG. 1 is a view in side elevation of a device for feeding preselected lengths of stock material from a coil to a punch press, illustrating feed rolls and pull rolls driven by a shaft drivingly connected to the crankshaft of the punch press so that the stock material is intermittently fed to the punch press in timed relation with the punching operation.
FIG. 2 is a view taken along line 2—2 of FIG. 1, illustrating the drive connection between the input shaft and the output shaft of the feed rolls for converting continuous rotation of the input shaft to intermittent rotation of the feed roll output shaft.
FIG. 3 is a view taken along line 3—3 of FIG. 1, illustrating meshing bevel gears for transmitting continuous rotation of the input shaft to the pull roll output shaft.

Referring to the drawings, and particularly to FIG. 1, there is illustrated apparatus generally designated by the numeral 10 for feeding stock material 12 to a punch press 14. The punch press has a crankshaft 16 which rotates in timed relation to dies 18 of the punch press so that there is a timed relationship to the punching portion of the punch press operation cycle and the rotational speed of the punch press crankshaft 16. A drive pulley 20 is rotated by the crankshaft 16. A feed roll unit generally designated by the numeral 22 is supported upon a horizontal bed 24 of an adjustable mounting bracket 26 that is movably supported by a frame 27 that rests upon the ground.

The feed roll unit 22 rotatably supports one end portion of an input shaft 28. A drive input pulley 30 is nonrotatably secured to the end portion of the input shaft 28 adjacent the punch press 14 in underlying relation with the drive pulley 20 on the crankshaft 16. An endless belt 31 is reeved about the pulleys 20 and 30 to drivingly connect the pulley 20 to the pulley 30. With this arrangement rotation of the crankshaft 16 is transmitted to the input shaft 28.

A geared cam drive generally designated by the numeral 32 in FIG. 2, drivingly connects the input shaft 28 to a driven feed roll 34 that is rotatably supported by the feed roll unit 22 and is positioned in overlying relation with an idler feed roll 36 which is rotatably supported by the feed roll unit 22. With this arrangement the stock material 12 is caught between the feed rolls 34 and 36. The geared cam drive 32, in a manner to be described later in greater detail, converts uniform, continuous rotation of input shaft 28 to noncontinuous, intermittent rotation of the driven feed roll 34 so that the feed rolls 34 and 36 intermittently advance preselected lengths of the stock material to the punch press 14 in timed relation with the punching operation. Thus, each time the dies 18 are actuated another length of the stock material is positioned between the dies.

A stock pulling unit generally designated by the numeral 38 is securely mounted on the horizontal bed 24 of mounting bracket 26 and rotatably supports a pair of pull rolls, such as driven pull roll 40 and idler pull roll 42. The pull rolls 40 and 42 are positioned so as to catch the stock material between the rolls. The driven pull roll 40 is continuously rotated so that stock material at a preselected speed is continuously unreeled from a coil 44 of stock material. The coil 44 is supported by a reel device 46 that is, in turn, rotatably mounted on a support 48 positioned on the ground. A conventional coil straightener 50 is positioned downstream from the pull rolls 40 and 42 and mounted on the bed 24. The coil straightener is operable to straighten out the stock material 12 as it is unreeled from the coil 44. The reel device 46 includes a torque limiting clutch which maintains a preselected tension on the stock material 12 between the stock pulling unit 38 and the coil 44.

The uniform, continuous rotation of the input shaft 28 is transmitted to the driven pull roll 40 by a bevel gear mechanism generally designated by the numeral 52 in FIG. 3. The bevel gear mechanism includes a first bevel gear 54 nonrotatably secured to the input shaft 28 and a second bevel gear 56 that is arranged in meshing relation with bevel gear 54 and nonrotatably secured to one end portion of an output shaft 58. The output shaft 58 is rotatably supported by the stock pulling unit 38. A first reduction gear 60 is nonrotatably secured to the opposite end portion of output shaft 58 and meshes with one of a plurality of reduction gears comprising a reduction gear train (not shown) in which the last reduction gear of the gear train is nonrotatably connected to one end portion of a shaft that rotates the driven pull roll.

With this arrangement the input shaft 28 transmits uniform, continuous rotary motion to the output shaft 28 to continuously rotate the driven pull roll 40 at a preselected speed. With the stock material 12 caught between the rolls 40 and 42, continuous rotation of roll 40 continuously advances stock material from the coil 44. The idler pull roll 42 may be secured to the end of a piston rod of a piston cylinder assembly 62 that is operable to move the roll 42 into and out of contact with the stock material 12.

While the pull rolls 40 and 42 rotate continuously to unreel stock material from the coil 44, the feed rolls 34 and 36 intermittently feed a preselected length of the stock material into punching position relative to the dies 18 of punch press 14. During the punching operation the intermittently driven feed rolls 34 and 36 interrupt advance of the stock material to the punch press 14; however, the continuously driven pull rolls 40 and 42 continue to unreel stock material from the coil 44. Consequently, an arcuate portion or loop 64 is formed in the stock material between the stock pulling unit 38 and the feed roll unit 22 during the punching operation. The loop 64 has the configuration as illustrated in FIG. 1 at the end of the punching operation. Idler rolls 66 and 68 rotatably supported above the bed 24 support the underside of loop 64 while rolls 70 and 72 prevent backlash of the stock material.

The pull rolls 40 and 42 continuously feed the stock material 12 during the punching operation; while, the feed rolls 34 and 36 interrupt feed of the stock material so that the loop 64 is formed during the punching operation. After the punching operation, the dies 18 are retracted and in timed relation therewith the geared cam drive 32 actuates the feed rolls 34 and 36 to rotate and advance the length of the stock material forming the loop 64 into punching position in the press 14.

At the end of the feeding operation subsequent to the next punching operation the stock material assumes or takes the position 74 illustrated by the dotted line in FIG. 1 between the units 22 and 38. In this position the stock material extends substantially horizontal between the units 22 and 38 so that all the stock material forming the loop 64 is fed to the punch press 14. The length of the loop 64 is a preselected length as determined by the requirements of the products to be produced by the punching operation. At the end of the feeding operation when the stock material is in the position 74, idler roll 76 is operable to prevent the stock material from vibrating. Preferably, the feed roll 34 is intermittently rotated at twice the rate of the continuously rotating pull roll 40.

The geared cam drive 32 is a commercially available right angle index drive as disclosed in U.S. Pat. No. 3,483,782, which is incorporated herein by reference. The geared cam drive 32 receives continuous, uniform motion through input shaft 28. The continuous, uniform motion is converted by the geared cam drive 32 to a non-continuous, step-by-step, intermittent motion which is transmitted by an output shaft 78. The geared cam drive 32 includes a drum portion 80 that is nonrotatably secured to input shaft 28. The drum portion 80 is provided with a cam 82 having a spiral vane 84 that forms a cam track 86 for receiving a cam follower 88 that is secured to the periphery of circular member 90 that is axially and nonrotatably secured to output shaft 78. The output shaft 78 is conventionally supported for rotation by bearings within the feed roll unit 22.

A reduction gear 92 comprising one of a plurality of reduction gears of a reduction gear train (not shown) is nonrotatably secured to the opposite end portion of output shaft 78. Rotation of gear 92 is transmitted through a plurality of gears through a final reduction gear that is nonrotatably secured to a shaft that supports the driven feed roll 34 in the feed roll unit 22. With this arrangement rotation of output shaft 78 is transmitted by reduction gear 92 to the other reduction gears and finally to the feed roll 34. With this arrangement rotation of feed roll 34 forwardly advances the stock material to the punch press 14. As with the idler pull roll 42, the idler feed roll 36 is movable into and out of contact with the underside of the stock material 12 by operation of a piston cylinder assembly 94. Extension and retraction of a piston rod of the assembly 94 moves the idler feed roll 36 into and out of engagement with the stock material.

In operation, rotation of crankshaft 16 is transmitted by belt 31 to input shaft 28. The input shaft 28 rotates the cam 82 so that the cam follower 88 moves along the cam track 86. During the dwell period of rotation of cam 82 the cam follower 88 is in contact with surface 96 of cam track 86, and the output shaft 78 does not rotate. Consequently, feeding of the stock material by the rolls 34 and 36 to the punch press 14 is interrupted and the loop 64 is formed in the stock material. However, once the cam follower 88 engages surface 98 of cam track 86 upon further rotation of cam 82, the output shaft 78 rotates to, in turn, rotate feed roll 34. Rotation of feed roll 34 advances the length of the stock material forming the loop 64 to the punch press 14.

At the end of the feeding operation to the punch press 14, the stock material assumes the horizontal position 74 between the units 22 and 38. The cam follower 88 engages surface 96 of cam track 86 and rotation of output shaft 78 is interrupted, as well as rotation of feed roll 34. The driven feed roll 34 is actuated for only a portion of each revolution of input shaft 28 as determined by the length of the cam track surface 98. Thus, for each revolution of input shaft 28 the feed roll 34 is intermittently rotated. Accordingly, the stock material is fed to the punch press 14 when feed roll 34 rotates and feed is interrupted to the punch press 14 when feed roll 34 does not rotate. In this manner the feed roll unit 22 operates intermittently to advance a preselected length of the stock material to the punch press for each cycle of operation thereof.

The length of stock material fed to the punch press 14 is controlled by the periodic interval of rotation of driven feed roll 34 and the rate of rotation of feed roll 34. The interval of rotation and rate of rotation of feed roll 34 is variable by making adjustments to the geared cam drive 32 and the gear train to feed roll 34. Because of the relative rate of rotation of the feed rolls and the pull rolls, the feed rolls 34 and 36 advance the stock material at a rate greater than the rate of advancement of the stock material by the pull rolls 40 and 42. At the end of each feeding operation all material forming the loop 64 is fed to the press 14. This insures that for each punching operation the same length of stock material is fed to the punch press.

According to the provision of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for the controlled feeding of stock material to a punching apparatus comprising, pull means for continuously pulling the stock material from a source, intermittent feed means for intermittently feeding a preselected length of the stock material to the punching apparatus, an input shaft adapted to be drivingly connected to the punching apparatus for rotation at a continuous preselected speed, said input shaft extending longitudinally parallel to the direction of feed from the punching apparatus to said intermittent feed means and therefrom to said pull means, first means for drivingly connecting said input shaft to said intermittent feed means to convert continuous rotation of said input shaft to intermittent rotation of said intermittent feed means for intermittently feeding a preselected length of the stock material to the punching apparatus in timed relation with the punching operation, second means for drivingly connecting said input shaft to said pull means to continuously rotate said pull means and continuously advance the stock material from the source to said intermittent feed means, said pull means being operable to continuously feed the stock material to said intermittent feed means at a rate to form a loop in the stock material between said pull means and said intermittent feed means while the punching apparatus performs to punching operation and while said intermittent feed means interrupts the feed of the stock material to the punching apparatus to thereby store in said loop the amount of stock material fed to the punching apparatus for each cycle of operation of the punching apparatus, and said intermittent feed means being operable to feed a preselected length of the stock material corresponding to the length of the stock material stored in the loop to the punching apparatus so that the stock material positioned between said pull means and said intermittent feed means moves from a looped position to a substantially horizontal position and all the stock material stored in said loop is fed to the punching apparatus and said loop is removed after the feeding operation.

2. Apparatus for the controlled feeding of stock material to a punching apparatus as set forth in claim 1 which includes, said intermittent feed means being operable to feed the stock material from the loop at a rate greater than the rate of feed of said pull means so that the stock material positioned between said pull means and said intermittent feed means assumes a substantially horizontal position removing said loop from the stock material after the feeding operation to the punching apparatus.

3. Apparatus for the controlled feeding of stock material to a punching apparatus as set forth in claim 1 which includes, said intermittent feed means being operable to feed the stock material to the punching apparatus so that the length of the stock material forming the loop is substantially equal to the length of the stock material fed to the punching apparatus after each punching operation.

4. Apparatus for the controlled feedig of stock material to a punching apparatus as set forth in claim 1 wherein, said feed means includes a feed roll maintained in contact with the surface of the stock material, a first output shaft, reduction gear means for drivingly connecting said first output shaft to said feed roll, said first means including cam gear means for drivingly connecting said input shaft to said first output shaft, and said cam gear means being operable to convert continuous rotary motion of said input shaft to intermittent rotary motion of said first output shaft to intermittently rotate said feed roll in timed relation with the punching operation so that the stock material forming the loop is fed to the punching apparatus after each punching operation.

5. Apparatus for the controlled feeding of stock material to a punching apparatus as set forth in claim 1 wherein, said pull means includes a pull roll maintained in contact with the surface of the stock material, said pull roll being positioned between the source of the stock material and said feed means in spaced relation with said feed means, a second output shaft, reduction gear means for drivingly connecting said second output shaft to said pull roll, said second means including bevel gear means for drivingly connecting said input shaft to said second output shaft, and said bevel gear means being operable to transmit continuous rotation of said input shaft to said second output shaft to continuously rotate said pull roll and continuously advance the stock material to said feed means at a preselected rate.

* * * * *